United States Patent [19]

Bomes et al.

[11] Patent Number: 5,060,795

[45] Date of Patent: Oct. 29, 1991

[54] GARMENT BAG

[75] Inventors: Harvey J. Bomes; Jack L. Barber, both of Baltimore, Md.

[73] Assignee: The Baltimore Luggage Company, Baltimore, Md.

[21] Appl. No.: 581,524

[22] Filed: Sep. 12, 1990

[51] Int. Cl.[5] ..... A45C 7/00

[52] U.S. Cl. ..... 206/279; 190/103; 190/111; 206/287; 206/287.1

[58] Field of Search ..... 190/14, 15 R, 15 A, 190/103-107, 111, 113, 119, 120; 206/278, 278.1, 279, 287, 287.1, 289, 291, 292

[56] References Cited

U.S. PATENT DOCUMENTS

| | | | |
|---|---|---|---|
| 1,841,154 | 1/1932 | Rath | 190/119 |
| 2,261,291 | 11/1941 | Salavsky | 190/113 |
| 3,175,658 | 3/1965 | Bierman . | |
| 3,443,671 | 5/1969 | Dyke . | |
| 4,098,376 | 7/1978 | Pelavin | 190/113 |
| 4,236,615 | 12/1980 | Ginat . | |
| 4,334,601 | 6/1982 | Davis . | |
| 4,361,215 | 11/1982 | Sawai . | |
| 4,613,039 | 9/1986 | Shaw et al. . | |
| 4,662,513 | 5/1987 | King et al. . | |
| 4,727,987 | 3/1988 | Zezza . | |
| 4,733,759 | 3/1988 | Shin-Chen . | |
| 4,773,515 | 9/1988 | Kotkins, Jr. . | |
| 4,782,947 | 11/1988 | Sheiman | 206/289 |
| 4,801,010 | 1/1989 | Levitas | 190/113 |
| 4,805,748 | 2/1989 | Gerch . | |
| 4,805,749 | 2/1989 | Gerch . | |

*Primary Examiner*—Jimmy G. Foster
*Attorney, Agent, or Firm*—Breiner & Breiner

[57] ABSTRACT

A garment bag comprising a front wall, a back wall, a top wall, a bottom wall, and side walls defining a storage compartment for carrying hanging garments having at least one expansion joint which allows the garment bag to selectively expand or contract to carry various length garments. The garment bag further includes an opening panel in the front wall of the garment bag capable of opening to substantially the width of the front wall to allow easy access to the storage compartment and snap fasteners to hold the panels in an open position.

9 Claims, 3 Drawing Sheets

10
12
16
24
26
28
29
30
32
34
36
38
40
42
44
46
47
47a
47b
70
72
74

74

54
16
56

28
28
30
29
26

58
14
50
52
26
64
66
60
56
54
48
48
18
50
52

GARMENT BAG

FIELD OF THE INVENTION

This invention relates to garment bags. More particularly, the invention relates to a garment bag with an expansion joint to selectively adjust the length of the garment bag and which garment bag also includes opening means to facilitate packing.

BACKGROUND OF THE INVENTION

Garment bags have been increasingly utilized over the past ten years in travel, particularly travel by business persons. Garment bags have been found quite useful for a number of reasons, including their ability to carry and retain in a pressed condition suits, shirts, coats, and dresses; the ability to carry the garment bag on an airplane without checking the bag to save time at the airport and avoid loss of the bag; they are lightweight and yet provide ample protection of the enclosed garments; and they may be folded and easily stored when not in use.

A problem with the existing garment bags is that they are generally sold in two lengths, one length for suits and shirts, and a second longer length for carrying coats and dresses. The traveler must, thus, either own two garment bags of different lengths or choose between the shorter or longer garment bags. In the latter instance, a traveler owning the shorter length garment bag will not be able to pack coats or dresses without the necessity of folding and wrinkling such garments. On the other hand, if one owns the longer length garment bag, there is the additional bulk and wasted space when only suits or shirts are carried in the garment bag. There is, therefore, a need for a garment bag which may be adjusted in length to meet the differing needs of the traveler.

The garment bag disclosed in U.S. Pat. No. 4,613,039 attempts to solve this problem by providing a drop bottom garment bag consisting of a slit in the bottom wall of the garment bag through which a pocket may extend outwardly to provide additional length to the main garment storage compartment. The extended pocket is then folded over the front panel of the garment bag for travel. The garment bag disclosed in this patent is not an entirely acceptable solution to the problem for a number of reasons. For example, the separate pocket or appendage extending through the slit in the bottom of the bag provides less room for the garments than the main storage area since it is tapered and does not extend the entire width of the garment bag and is not integral with the main storage compartment of the garment bag. Further, the pocket must be folded over the garment bag thereby folding the garments carried therein, and adding additional width and bulk to the folded garment bag. Additionally, the pocket extending through the slit is cumbersome to use and is not attractive in appearance since the contour is different from the remainder of the bag. Accordingly, there remains a need for a garment bag which may be selectively adjusted to different lengths.

It is also known in the art to provide expansible luggage cases and hand cases such as disclosed in U.S. Pat. Nos. 3,443,671; 4,236,615; 4,334,601; 4,361,215; 4,773,515; 4,733,759; 4,805,748; and 4,805,749. However, each of these patents relate to an expansion joint used in expanding a luggage case or hand bag and do not relate to a garment bag or address the corresponding problems of a garment bag as discussed above.

An additional problem with garment bags as presently constructed relates to packing the garment bag. Specifically, garment bags generally include a zipper opening in the front wall for the insertion and hanging of the garments. The opening panel or panels of the front wall of the garment bag in many instances opens only partially and is difficult to maintain in an open position while packing. Accordingly, the garments must be inserted into the garment bag at an angle and the garments must be tucked into the bag through the opening. Additionally, the panels tend to fall closed and must be held open manually. In an attempt to resolve these problems, garment bags have been constructed with retractable rods to hold the panels open. However, such garment bags are not an acceptable solution due to, among other things, their cost to manufacture, their complexity, and their cumbersome nature. Accordingly, there is a need for a garment bag which has an opening at least the width of the garment to be packed and which will remain open.

PRIMARY OBJECTS AND SUMMARY OF THE INVENTION

It is a primary object of the present invention to provide a garment bag having at least one expansion joint in the garment bag to selectively adjust the length of the garment bag to allow for the carrying of various length garments.

It is a further primary object of the invention to provide a garment bag which includes an opening means having two panels which open by a separator zipper means to provide a large garment opening to facilitate packing of garments.

It is a further object of the invention to provide a garment bag which includes an opening means having two panels which when opened may be held open by a fastening means.

It is a further object of the invention to provide separate storage compartments which extend outwardly from the garment bag and have top opening flaps to provide easy packing.

It is a still further object of the invention to provide separate storage pockets which are constructed to allow the outer panel of the pocket to overlie the zipper fastening means to provide an attractive streamlined appearance and to protect the zipper fastening means from damage.

It is another object of the invention to provide a garment bag as described which is durable, attractive in appearance, simple in design and manufacture, and easy to use by the traveler.

The garment bag of the present invention comprises a front wall, a back wall, a top wall, a bottom wall, and side walls defining a storage compartment for carrying hanging garments such as suits, shirts, dresses, and coats. At the bottom of the garment bag is at least one expansion joint which allows the garment bag to selectively expand or contract to carry various length garments.

An additional aspect of the invention is an opening means in the front wall of the garment bag which includes two panels which are capable of opening by a separate zipper means to substantially the width of the front panel of the garment bag to allow easy access to the storage compartment and which includes fastening means to hold the panels in an open position while being packed.

Other objects and advantages of the invention will become apparent from the drawings and description of the invention.

DESCRIPTION OF THE PRESENTLY PREFERRED EMBODIMENT

Figures 1, 2, 3:
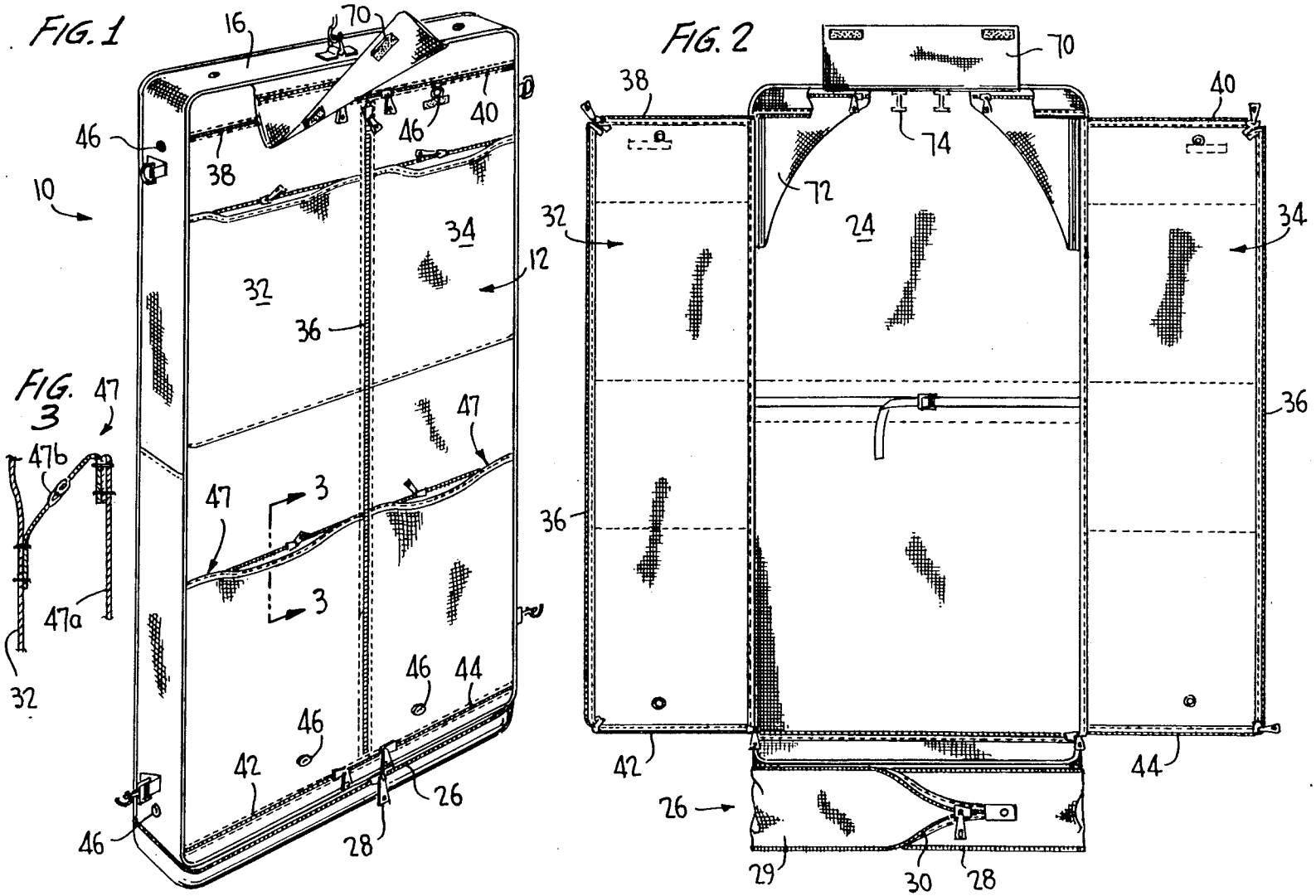
FIG. 1 is a perspective view of the garment bag invention showing the expansion joint in the closed position and the opening means in the closed position.
FIG. 2 is a front elevational view of the invention showing the opening means in the open position and the expansion joint in the open or expanded position.
FIG. 3 is an enlarged partial cross-sectional view of the storage compartment taken along line 3—3 of FIG. 1.

The garment bag 10 of the present invention includes a front wall 12, a back wall 14, a top wall 16, a bottom wall 18, and side walls 20 and 22. These walls are connected by any suitable means such as stitching to define a main storage compartment 24. The garment bag is made, preferably, of a durable, lightweight, soft material such as nylon.

At the bottom of the garment bag there is provided at least one expansion joint 26. In the preferred embodiment, the garment bag utilizes a single expansion joint 26 which allows for expansion of the bag approximately 6 inches in length. However, additional expansion joints may be used to provide for further extension of the bag. The expansion joint is of the type disclosed in U.S. Pat. No. 3,443,671. The expansion joint includes a slide pull 28 and zipper means 30 for expanding and contracting the garment bag through expansion sleeve 29. It is noted that the slide pull 28 is enlarged to identify the expansion means and to differentiate it from the other slide pulls on the garment bag. In the alternative, a different colored slide pull may be used for this purpose.

Figures 4, 5, 7, 8:
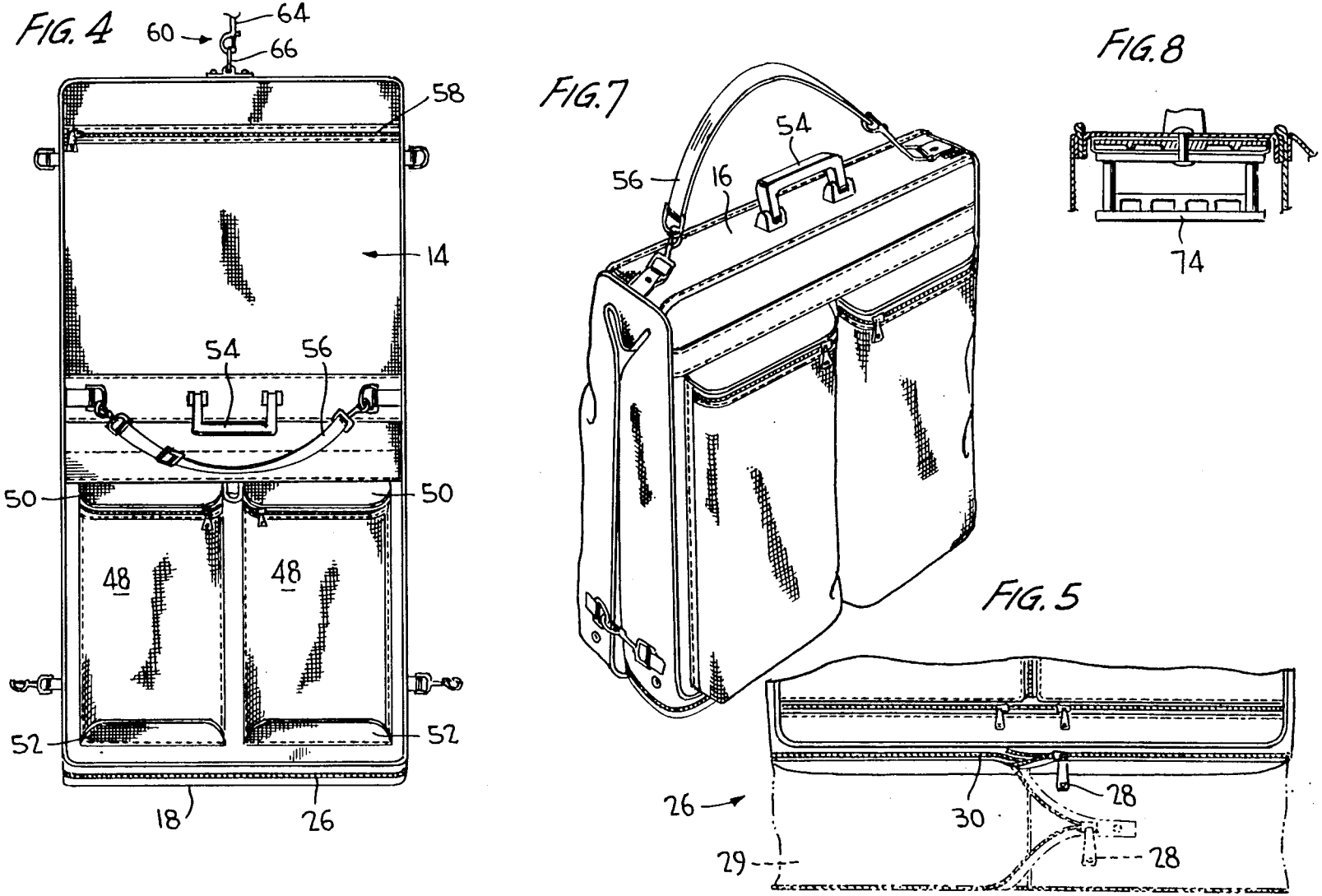
FIG. 4 is a back elevational view of the invention.
FIG. 5 is a partial enlarged front elevational view of the expansion joint in contracted position and in phantom lines in the expanded position.
FIG. 7 is a perspective view of the garment bag folded over for travel.
FIG. 8 is a partial side elevational view in partial cross section of the hanger means.

As best illustrated in FIGS. 2 and 5, one end of the zipper tracks 30 of the expansion joint 26 underlies the opposite end of the zipper tracks in an overlapping relation. When the expansion joint is closed, the slide pull 28 and zipper means 30 appears as in FIGS. 1, 4, and 5. Referring to FIGS. 2 and 5, the garment bag is opened to be expanded by pulling the zipper pull 28 of the zipper means 30 completely around the circumference of the garment bag thereby expanding the length of the bag through expansion sleeve 29. As apparent, the garment bag is expanded in its entire width and length.

Figure 6:
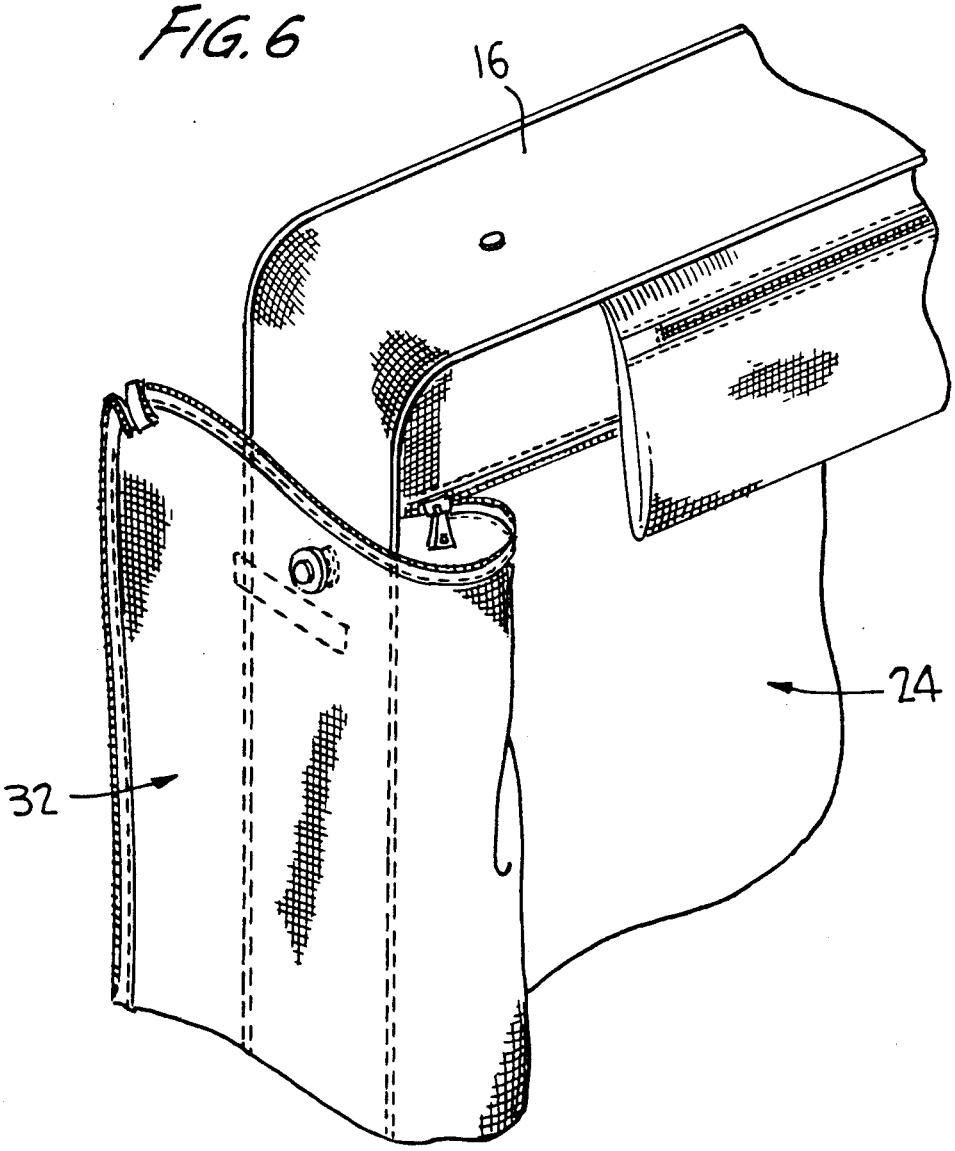
FIG. 6 is an enlarged partial perspective view of one front panel in the opened and the fastened position.

The front wall 12 of the garment bag includes panels 32 and 34 which allow access to the main storage compartment 24. Panels 32 and 34 are connected to the front wall and opened by a separator zipper means which includes a vertical zipper means 36 and a transverse zipper means 38 and 40 at the top of the bag and 42 and 44 at the bottom of the bag. When the panels 32 and 34 are opened by the separator zipper means, the panels are allowed to be folded back and open to expose substantially the entire storage compartment of the garment bag as shown in FIG. 2. Panels 32 and 34 are held in the open position by fastening means 46 which, in the preferred embodiment, are snap means as shown, for example, in FIG. 6. It is understood that other fastening means may be used such as Velcro or the like.

Additionally, panels 32 and 34 may include separate storage pockets 47 which are constructed to allow the outer panel **47*a* to overlie the zipper fastening means 47*b*** to provide a flat streamlined appearance which is both attractive in appearance and functional. Thus, the zipper is hidden from view and lays flat and also the zipper is protected from being damaged.

Back wall 14 includes separate storage compartments 48 which include top lids 50 and bottom walls 52 which each extend outwardly from the back wall 14 to provide a larger storage compartment. Accordingly, top lid 50 may be lifted up to allow easy access to the storage compartments 48. Additionally, back wall 14 includes a handle means 54, a shoulder strap 56, and an additional zippered storage compartment 58.

Top wall 16 includes a hanging means 60 comprising a hook and chain (not shown), dog leash 64, and ring 66. The hook and chain may be detachably released from ring 66 by dog leash 64 and stored in compartment 70 which extends outwardly from the front and top walls and is fastened to front wall 12 by Velcro.

Storage compartment 24 ma include separate triangular storage compartments 72 and two universal hanging clips 74 as shown, for example, in FIG. 8 for hanging garments.

As seen from the above description, the garment bag of the present invention provides for a new and novel garment bag which may expand in length to carry different length garments. Additionally, the garment bag provides for a large opening to facilitate packing. Thus, the garment bag of the present invention provides for a durable, lightweight, and attractive garment bag which is easy to use by the traveler.

It will be apparent that various modifications of the garment bag of the present invention may be made by one skilled in the art without departing from the spirit and scope of the invention as set forth in the appended claims.

It is claimed:

1. A garment bag comprising a front wall, a back wall, a top wall, a bottom wall, and side walls defining a main storage compartment for carrying hanging garments, said top wall including means on the inside surface thereof for hanging at least one garment, at least one expansion joint at about the bottom of the garment bag to selectively expand and contract the length of said main storage compartment of said garment bag, said expansion joint comprising a zipper pull and zipper means extending around the circumference of said garment bag and a flexible expansion sleeve and wherein when said garment bag is in its expanded state said main compartment is extended in length through substantially its entire width and depth.

2. A garment bag according to claim 1 wherein said front wall includes an opening means substantially the width of the front wall comprising first and second opening panels attached to said front walls, a separator zipper means for opening and closing said first and second panels, and a fastening means to hold said first and second panels open.

3. A garment bag according to claim 2 wherein said fastening means includes at least one snap means for each panel.

4. A garment bag according to claim 1 wherein said back wall includes at least one separate storage compartment having a top lid and bottom wall extending outwardly said back wall, a zipper means for opening and closing said top lid, whereby said top lid is lifted up when said zipper means is in the open position.

5. A garment bag according to claim 1 wherein said front wall includes at least one separate storage pocket having an outer panel and zipper closure means wherein the outer panel is constructed and arranged to overlie the zipper closure means.

6. A garment bag comprising a front wall, a back wall, a top wall, a bottom wall, and side walls defining a main storage compartment for carrying hanging garments, said front wall including an opening means substantially the width of the front wall comprising first and second opening panels attached to said front wall, a separator zipper means for opening and closing said first and second panels, and a fastening means to hold said first and second panels open.

7. A garment bag according to claim 6 wherein said fastening means comprises at least one snap means for each panel.

8. A garment bag according to claim 7 wherein said garment bag includes at least one expansion joint at the bottom end of the garment bag to selectively expand and contract said garment bag to carry various length garments said expansion joint comprising a zipper pull and zipper means extending completely around the circumference of the garment bag and a flexible expansion sleeve.

9. A garment bag comprising a front wall, a back wall, a top wall, a bottom wall, and side walls defining a main storage compartment for carrying hanging garments, said top wall including means on the inside surface thereof for hanging at least one garment, at least one expansion joint at about the bottom of the garment bag to selectively expand and contract the length of said main storage compartment of said garment bag, said expansion joint comprising a zipper pull and zipper means extending around the circumference of said garment bag and a flexible expansion sleeve wherein when said garment bag is in its expanded state said main compartment is extended in length through substantially its entire width and depth, at least one separate storage compartment in at least one of said front and back walls having a zipper pull and zipper means for opening and closing said separate storage compartment, and wherein the zipper of said expansion joint is enlarged to identify the zipper pull of the expansion joint from said zipper pull of said separate storage compartment.

* * * * *